US008989644B2

(12) United States Patent
Ueno et al.

(10) Patent No.: US 8,989,644 B2
(45) Date of Patent: Mar. 24, 2015

(54) IMAGE FORMING APPARATUS HAVING FIXING UNIT WITH IMPROVED LIGHT EMISSION, FIXING DEVICE, AND DRYING DEVICE

(71) Applicant: Fuji Xerox Co., Ltd., Tokyo (JP)

(72) Inventors: Osamu Ueno, Kanagawa (JP); Tomoaki Kojima, Kanagawa (JP); Masateru Yamamoto, Kanagawa (JP); Masahiro Yoshikawa, Kanagawa (JP); Kohei Yukawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 31 days.

(21) Appl. No.: 13/904,794

(22) Filed: May 29, 2013

(65) Prior Publication Data

US 2014/0126941 A1 May 8, 2014

(30) Foreign Application Priority Data

Nov. 8, 2012 (JP) ..... 2012-246446

(51) Int. Cl.
*G03G 15/20* (2006.01)
*G03G 15/11* (2006.01)
*B41J 2/01* (2006.01)

(52) U.S. Cl.
CPC ..... *G03G 15/2007* (2013.01)
USPC ..... 399/336; 399/251; 347/102

(58) Field of Classification Search
USPC ..... 399/336, 251; 347/102
See application file for complete search history.

(56) References Cited

U.S. PATENT DOCUMENTS

| | | | | |
|---|---|---|---|---|
| 7,433,627 | B2 * | 10/2008 | German et al. | 399/102 |
| 2005/0185040 | A1 * | 8/2005 | Nagashima | 347/102 |
| 2005/0235851 | A1 * | 10/2005 | Beier et al. | 101/424.1 |
| 2006/0050133 | A1 * | 3/2006 | Kokubo | 347/129 |
| 2008/0278560 | A1 * | 11/2008 | Niekawa | 347/102 |
| 2009/0148620 | A1 * | 6/2009 | Petermann | 427/511 |
| 2010/0201773 | A1 * | 8/2010 | Ohnishi | 347/102 |
| 2012/0062666 | A1 * | 3/2012 | Roof et al. | 347/102 |
| 2013/0071161 | A1 * | 3/2013 | Ueno et al. | 399/336 |

FOREIGN PATENT DOCUMENTS

| | | | |
|---|---|---|---|
| JP | 7-191560 | A | 7/1995 |
| JP | 2004-098685 | A | 4/2004 |
| JP | 2009-094308 | A | 4/2009 |

* cited by examiner

*Primary Examiner* — G. M. Hyder
(74) *Attorney, Agent, or Firm* — Sughrue Mion, PLLC

(57) ABSTRACT

An image forming apparatus includes an image forming device forming an image on a recording medium; and a light source that, after the image has been formed by the image forming device, irradiates the recording medium with light to fix the image on the recording medium, while the recording medium moves relatively in a predetermined movement direction. The light source includes a current supply section, a light emitting section, and a current output section. Current for light emission is supplied to the current supply section. The light emitting section includes light emitting elements that are disposed two-dimensionally. At least the light emitting elements provided side by side in the movement direction are electrically connected in parallel. The current output section outputs the current that has passed through the light emitting section. The current supply section and the light emitting section are provided side by side in the movement direction.

14 Claims, 9 Drawing Sheets

IMAGE FORMING APPARATUS HAVING FIXING UNIT WITH IMPROVED LIGHT EMISSION, FIXING DEVICE, AND DRYING DEVICE

CROSS-REFERENCE TO RELATED APPLICATIONS

This application is based on and claims priority under 35 USC 119 from Japanese Patent Application No. 2012-246446 filed Nov. 8, 2012.

BACKGROUND

1. Technical Field

The present invention relates to an image forming apparatus, a fixing device, and a drying device.

2. Summary

According to an aspect of the invention, there is provided an image forming apparatus including an image forming device that forms an image on a recording medium; and a light source that, after the image has been formed by the image forming device, irradiates the recording medium with light to fix the image on the recording medium, while the recording medium moves relatively in a predetermined movement direction. The light source includes a current supply section, a light emitting section, and a current output section. Electric current for light emission is supplied to the current supply section. The light emitting section includes light emitting elements that are disposed two-dimensionally. At least the light emitting elements that are provided side by side in the movement direction among the light emitting elements are electrically connected in parallel. The current output section outputs the electric current that has passed through the light emitting section. The current supply section and the light emitting section are provided side by side in the movement direction.

BRIEF DESCRIPTION OF THE DRAWINGS

Exemplary embodiments of the present invention will be described in detail based on the following figures, wherein.

DETAILED DESCRIPTION

First Exemplary Embodiment

An exemplary embodiment of the present invention is hereunder described in detail with reference to the drawings.

Image Forming Apparatus

Figure 1:
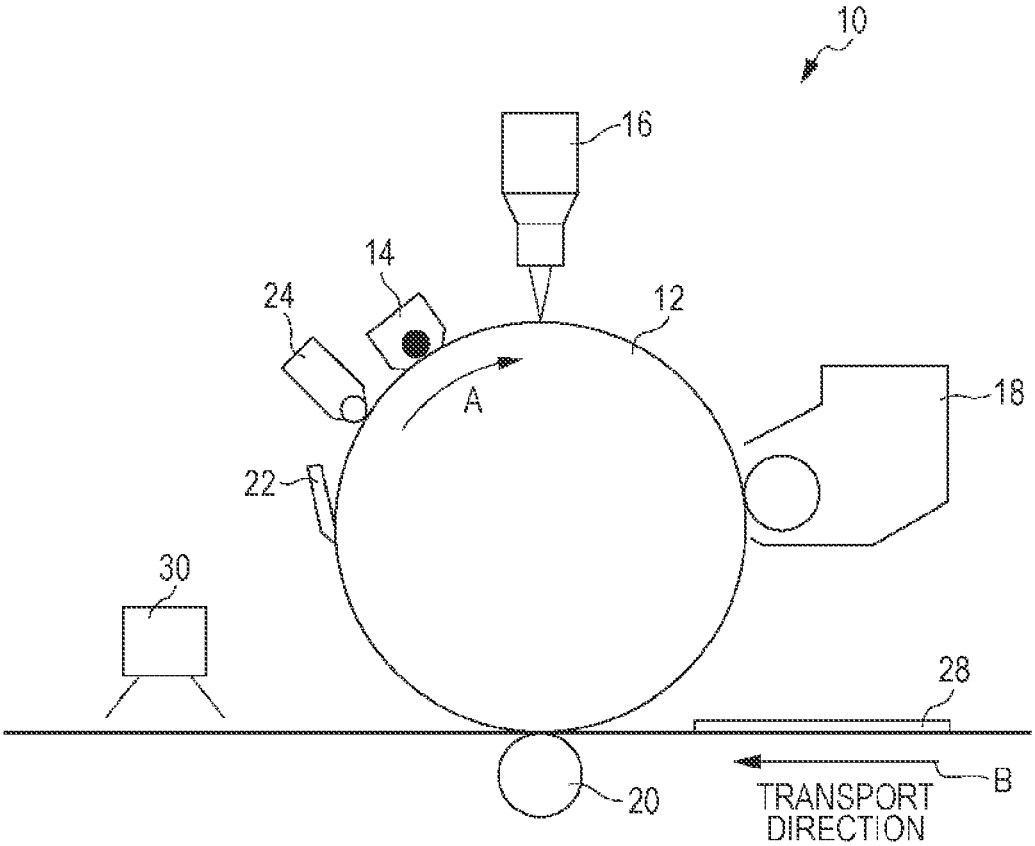
FIG. 1 is a schematic view of the structure of an exemplary image forming apparatus according to a first exemplary embodiment.

In the first exemplary embodiment shown in FIG. 1 that is a schematic view of the structure of an exemplary image forming apparatus according to the first exemplary embodiment, application to an image forming apparatus 10 that forms an image using toner is described in detail.

As shown in FIG. 1, the image forming apparatus 10 according to the first exemplary embodiment forms an image on a sheet (recording medium) 28 while transporting the sheet 28 in the direction of arrow B.

The image forming apparatus 10 according to the first exemplary embodiment includes a photoconductor member 12 that rotates at a constant velocity in the direction of arrow A. A charging unit (charging device) 14, a light source head (exposing device) 16, a developing unit (developing device) 18, a transfer member (transfer device) 20, a cleaner 22, and an erase lamp 24 are disposed in that order around the photoconductor member 12 in the direction of rotation of the photoconductor member 12. The charging unit 14 charges the surface of the photoconductor member 12. The light source head 16 performs exposure for forming an electrostatic latent image on the surface of the photoconductor member 12 that has been charged by the charging unit 14. The developing unit 18 develops the electrostatic latent image using developer for forming a toner image. The transfer member transfers the toner image to the sheet (recording medium) 28. The cleaner 22 removes residual toner remaining on the photoconductor member 12 after the transfer. The erase lamp 24 removes electricity from the photoconductor member 12 to equalize potential.

That is, after the surface of the photoconductor member 12 has been charged by the charging unit 14, the light source head 16 irradiates the surface of the photoconductor member 14 with light to form a latent image on the photoconductor member 12. The light source head 16 including light emitting elements is connected to a driving section (not shown). The driving section controls lighting of the light emitting elements, so that light is emitted on the basis of image data.

Toner is supplied to the formed latent image using the developing unit 18, so that a toner image is formed on the photoconductor member 12. The transfer member 20 transfers the toner image on the photoconductor member 12 onto the sheet 28 that has been transported. Residual toner on the photoconductor member 12 after the transfer is removed by the cleaner 22. After residual electric charges on the surface of the photoconductor member 12 have been removed by illumination light emitted from the erase lamp 24, the surface of the photoconductor member 12 is recharged by the charging unit 14, and the same operations are repeated.

The sheet 28 to which the toner image has been transferred is transported to a fixing unit 30 (fixing device) including light-emitting-element array chips 60 including light emitting elements, and is irradiated with light from the light emitting elements of the fixing unit 30, so that a fixing operation is performed. The fixing unit 30 including the light emitting elements is connected to a driving circuit (not shown). The driving circuit controls the lighting of the light emitting elements, so that light is emitted towards the sheet 28.

In this way, the toner image is fixed, so that a desired image is formed on the sheet 28. The sheet 28 on which the image has been formed is discharged outside the apparatus.

Fixing Unit

Next, the fixing unit according to the exemplary embodiment is described in detail.

Figure 2:
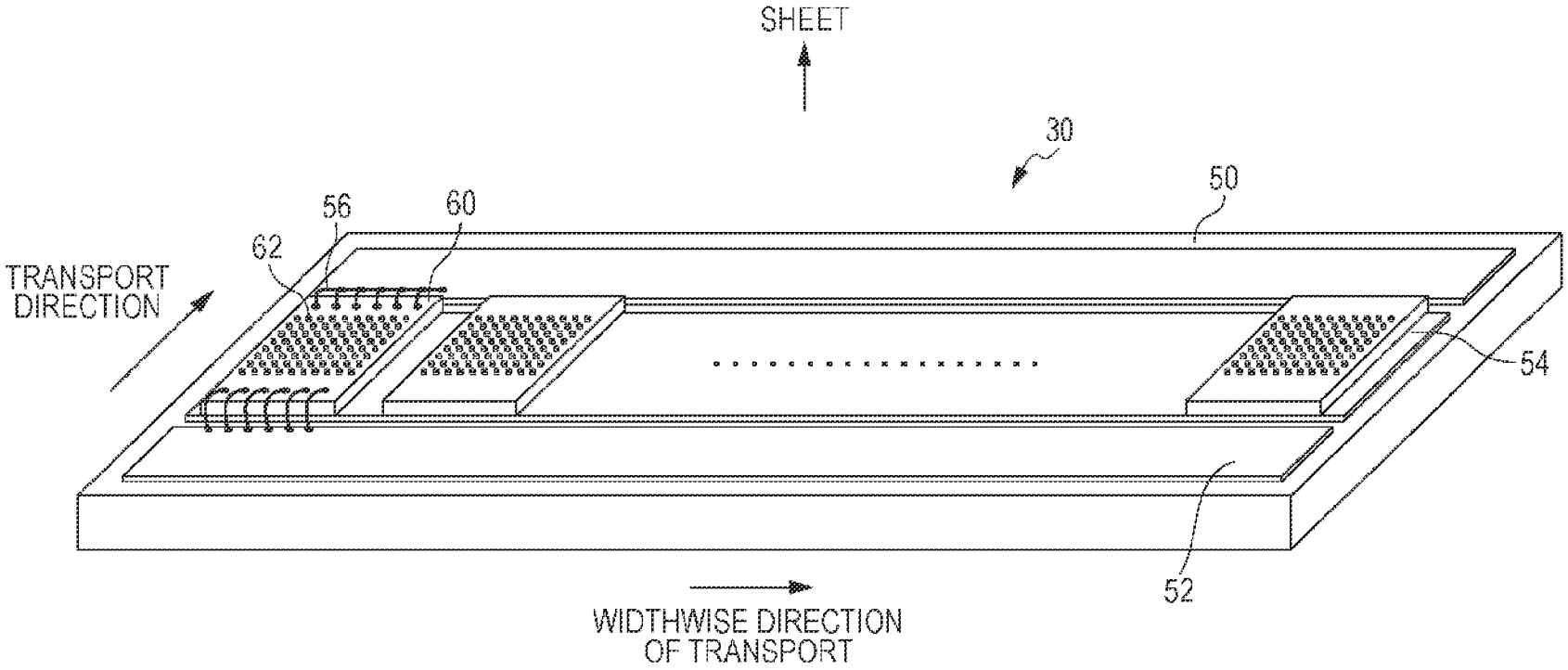
FIG. 2 is a schematic view of the structure of a fixing unit according to the first exemplary embodiment.

The structure of the fixing unit 30 according to the exemplary embodiment is described. FIG. 2 is a schematic view of the structure of the fixing unit 30 according to the first exemplary embodiment.

The fixing unit 30 according to the exemplary embodiment is provided in a direction that crosses a transport direction of the sheet 28 (hereunder referred to as the "widthwise direction of transport"). In the exemplary embodiment, the entire horizontal region (in the widthwise direction of transport) of the sheet 28 is capable of being irradiated with light at the same time or substantially at the same time. Therefore, the fixing unit 30 has a length that is substantially in correspondence with the horizontal width of the sheet 28 (that is, the width of the sheet 28 in the widthwise direction of transport).

The fixing unit 30 according to the exemplary embodiment includes positive wires 52, a negative wire 54, and light-emitting-element array chips 60, which are provided on a printed wiring board 50. The positive wires 52 form positive wire patterns. The negative wire 54 forms a negative wire pattern. The positive wires 52, the negative wire 54, and the light-emitting-element array chips 60 are disposed side by side along the widthwise direction of transport in a range that substantially corresponds to the horizontal width of the sheet 28. The positive wires 52 are connected to positive electrodes 74 (anode electrodes) of the light-emitting-element array chips 60, and electric current is supplied to the light-emitting-element array chips 60 from a driving circuit (not shown). The negative wire 54 is connected to negative electrodes 75 (cathode electrodes) of the light-emitting-element array chips 60, and causes electric current that is output from the light-emitting-element array chips 60 to return to the driving circuit. In the exemplary embodiment, electric currents that are supplied to the positive wires 52 and the negative wire 54 from the driving circuit may be supplied from an end portion or a central portion of the printed wiring board 50 in a longitudinal direction thereof. The electric current supplied from the driving circuit may be supplied from either a constant voltage source or a constant current source.

Light emitting elements 62 of the light-emitting-element array chips 60 are two-dimensionally disposed. In the exemplary embodiment, vertical cavity surface emitting lasers (VCSELs) are used as the light emitting elements. In the exemplary embodiment, the light-emitting-element array chips 60 are disposed side by side on the printed wiring board 50 in the widthwise direction of transport (that is, in the direction that crosses the transport direction) in the range that substantially corresponds to the width of a recording medium. The positive electrodes 74 of the light-emitting-element array chips 60 according to the exemplary embodiment and the positive wires 52 are connected to each other using bonding wires 56. Driving current that flows from the driving circuit (not shown) is supplied to the light-emitting-element array chips 60 from the positive wires 52 via the bonding wires 56, and flows to the negative wire 54 from the negative electrodes 75 of the light-emitting-element array chips 60. This causes the light emitting elements 62 to emit light, and the light to be directed towards the sheet 28. In the exemplary embodiment, the width of a light emitting section including the light emitting elements 62 in the widthwise direction of transport substantially corresponds to the width of its corresponding light-emitting-element array chip 60 itself.

Figure 3:
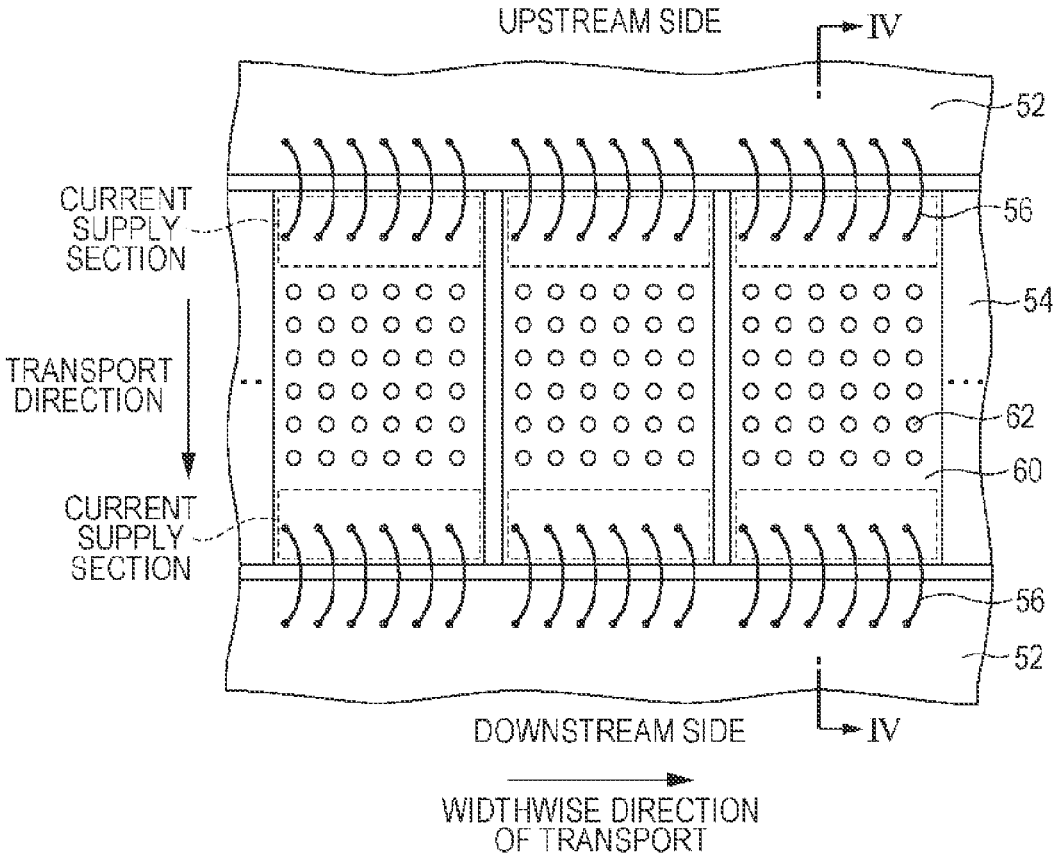
FIG. 3 is a plan view of a portion of the fixing unit shown in FIG. 2 when seen from the top thereof (that is, from a light illuminating side)
Figure 4:
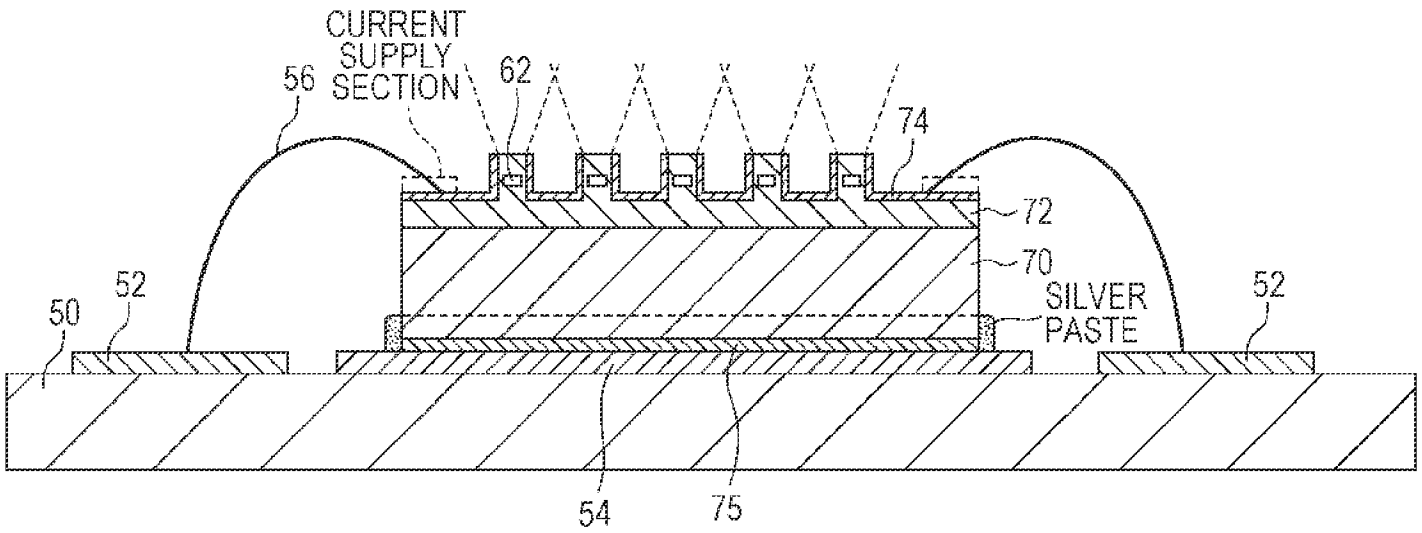
FIG. 4 is a sectional view taken along line IV-IV of the fixing unit shown in FIG. 3.

The fixing unit 30 according to the exemplary embodiment is described in more detail with reference to the drawings. FIG. 3 is a plan view of a portion of the fixing unit 30 when seen from the top thereof (that is, from a light illuminating side). FIG. 4 is a sectional view taken along line IV-IV of the fixing unit 30 shown in FIG. 3. FIGS. 2, 3, and 4 are each a schematic view of the fixing unit 30 according to the exemplary embodiment. For example, the bonding wires 56, the light-emitting-element array chips 60, the light emitting elements 62 are examples, and are not limited to those that are illustrated.

The light-emitting-element array chips 60 used in the fixing unit 30 according to the exemplary embodiment are VCSEL array chips in which the light emitting elements 62 are two-dimensionally disposed. The light-emitting-element array chips 60 are surface-emitting VCSEL array chips. A semiconductor layer 72 is formed on an n-type GaAs substrate 70. The semiconductor layer 72 is provided with a distribution bragg reflector (DBR) or an active layer including a p-type or an n-type semiconductor layer. Examples of p-type semiconductor layers are an AlGaAs semiconductor layer or an InGaAs semiconductor layer. The light emitting sections including the light emitting elements 62 emit light that has been generated.

The entire back surface of each light-emitting-element array chip 60 is a negative electrode (which is formed of a metallic material such as Au), is disposed on the negative wire 54, and is connected to the negative wire 54 using, for example, a silver paste. Excluding a light exiting opening of each light-emitting-element array chip 60, the entire front surface of each light-emitting-element array chip 60 is covered with a metallic material, such as Au, and constitutes a positive electrode. The positive wires 52 are disposed, respectively, at an upstream side and a downstream side of the negative wire 54 (light-emitting-element array chips 60) in the transport direction. The light-emitting-element array chips 60 are connected to the positive wires 52 using bonding wires 56. The light emitting elements 62, which are formed between the positive electrodes 74 and the corresponding negative electrodes 75, are two-dimensionally disposed, and are electrically connected in parallel. Accordingly, each light-emitting-element array chip 60 according to the exemplary embodiment is an electrode in which the positive electrode 74 is continuously formed on both sides of the light emitting elements 62, and is such that electric current is supplied in parallel to the light emitting elements 62 via the continuously formed electrode. Not all of the light emitting elements in each of the light-emitting-element array chips 60 need to be connected in parallel. The light emitting elements 62 may be connected in parallel with every plural number of light emitting elements 62.

In the exemplary embodiment, each light-emitting-element array chip 60 is provided with a current supply section. The bonding wires 56 are connected to an upstream edge of each light-emitting-element array chips 60 along the widthwise direction of transport, to supply electric current to the corresponding current supply section. Each current supply section is a portion of its corresponding positive electrode 74, and has a width that substantially corresponds to the width including the light emitting elements 62 (that is, a width substantially corresponding to the width of its corresponding light-emitting-element array chip 60). The bonding wires 56 are connected to the positive wire 52 that is disposed upstream while the bonding wires 56 are disposed side by side in the widthwise direction of transport. Similarly, in the exemplary embodiment, each light-emitting-element array chip 60 is provided with another current supply section that is provided at a downstream edge of its corresponding light-emitting-element array chip 60. The light-emitting-element array chips 60 are connected to the positive wire 52 that is disposed downstream using the bonding wires 56. Driving current supplied from the positive wires 52 is supplied to the current supply sections of the light-emitting-element array chips 60 via the bonding wires 56, and flows along the positive electrodes 74 in the transport direction. Then, the driving current flows out to the negative wire 54 via the negative electrodes 75 functioning as current output sections via the light emitting elements 62, so that the light emitting elements 62 emit light. In the exemplary embodiment, the positive wires 52 and the light-emitting-element array chips 60 are connected to each other using the bonding wires 56. It is desirable that a plural number of bonding wires 56 be provided for each light-emitting-element array chip 60 substantially in correspondence with the width of the light emitting section in the widthwise direction of transport. When a plural number of bonding wires 56 are provided substantially in correspondence with the width of the light emitting section, electric current flows more in the transport direction than when bonding wires 56 are provided substantially in correspondence with only part of the width of the light emitting section. In addition, it is desirable that a plural number of bonding wires 56 be provided at substantially equal intervals along the widthwise direction of transport.

In the fixing unit 30 according to the exemplary embodiment, when electric current is supplied to the light-emitting-element array chips 60, electric current is supplied downstream in the transport direction from the current supply sections that are disposed at the upstream side in the transport direction, and electric current is supplied upstream in the transport direction from the current supply sections that are disposed at the downstream side.

Here, since the positive electrodes 74 of the light-emitting-element array chips 60 according to the exemplary embodiment have a plural number of light-exiting openings, the paths for electric current flow are limited. In addition, a plural number of light emitting elements 62 are two-dimensionally disposed, and are electrically connected in parallel. Therefore, the longer the supply path from the corresponding current supply section to the light emitting elements through the corresponding positive electrode 74 whose path for electric current flow is limited, the smaller the amount of supplied electric current due to an increase in wire resistance. That is, in the exemplary embodiment, the light emission amount of the light emitting elements 62 that are disposed at the upstream side in the direction of electric current flow tends to be larger than the light emission amount of the light emitting elements 62 that are connected in parallel at the downstream side because a larger amount of electric current flows through the upstream light emitting elements 62.

When the light-emitting-element array chips 60 having such a structure are used in the fixing unit 30, if the fixing unit 30 is formed so that electric current flows in the widthwise direction of transport, differences between the exiting light amounts in the widthwise direction of transport occur. As a result, differences between the amounts of received light at regions on a sheet 28 in the widthwise direction of transport occur, as a result of which differences in fixing characteristics.

Therefore, in the exemplary embodiment, in the range of the width of the sheet 28, the current supply sections, the plural number of light emitting elements 62, and the negative electrodes 75, which are provided at the light-emitting-element array chips 60, are disposed side by side in the transport direction. By virtue of this structure, electric current flows in the transport direction of the sheet 28, so that differences between the amounts of light that are emitted to the sheet 28 in the widthwise direction of transport are reduced.

In the transport direction, in accordance with the distances from the current supply sections to the light emitting elements 62 in the transport direction (that is, the wire resistances), differences between the supplied electric current amounts occur, as a result of which differences between the light emission amounts in the transport direction occur. However, even if differences between light emission amounts in the transport direction occur, since the amounts of light used to illuminate the regions of the sheet 28 in the widthwise direction of transport are determined on the basis of integrated values of light emission amounts in the transport direction, the effect of uneven light emission in the transport direction upon the fixing operation is smaller than that of uneven light emission in the widthwise direction of transport upon the fixing operation.

In addition, in the exemplary embodiment, electric current is supplied from both the upstream side and the downstream side in the transport direction. Therefore, compared to a structure in which electric current is supplied from only one side, the paths to the light emitting elements 62 are shorter. As a result, uneven light emission in the transport direction is suppressed, so that uneven light emission in the two-dimensional light emitting sections is suppressed as a whole. In addition, connection regions are provided at both the upstream side and the downstream side. Therefore, compared to a structure in which connection regions are provided at only one side, it is possible to use a larger number of bonding wires 56.

Second Exemplary Embodiment

A fixing unit 30 according to another exemplary embodiment is described. Structural features and operations that are substantially the same as those according to the first exemplary embodiment are not described in detail.

Figure 5:
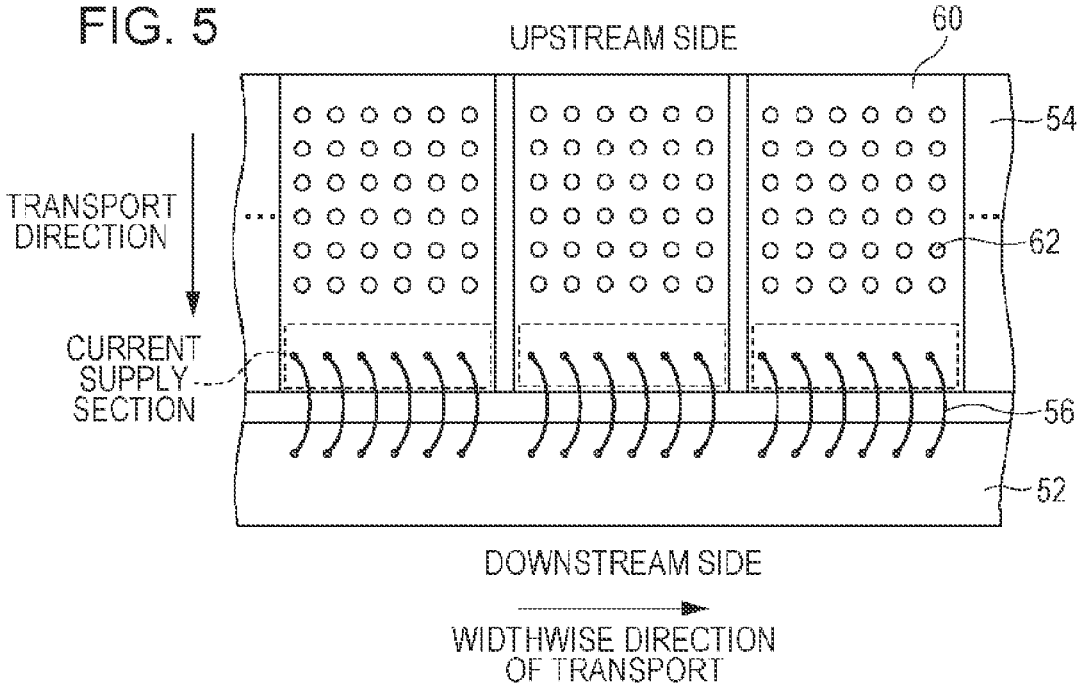
FIG. 5 is a plan view of a portion of a fixing unit according to a second exemplary embodiment when seen from the top thereof (that is, from a light illuminating side)

FIG. 5 is a plan view of a portion of the fixing unit 30 according to the second exemplary embodiment when seen from the top thereof (that is, from a light illuminating side). In the fixing unit 30 according to the first exemplary embodiment, the current supply sections of the light-emitting-element array chips 60 are disposed at both the upstream side and the downstream side in the transport direction, and electric current is supplied from both the upstream side and the downstream side. In contrast, in the second exemplary embodiment, as shown in FIG. 5, current supply sections of the light-emitting-element array chips 60 are disposed on one side, and electric current is supplied from only one side. The other structural features of the second exemplary embodiment are substantially the same as those of the first exemplary embodiment. FIG. 5 shows, as an example of disposing the current supply sections at one side, the case in which the current supply sections of the light-emitting-element array chips 60 are disposed at the downstream side in the transport direction. However, the current supply sections may be disposed at the upstream side in the transport direction.

Therefore, in the second exemplary embodiment, as in the first exemplary embodiment, uneven light emission in the widthwise direction of transport is suppressed, as a result of which uniformity in light amount distribution is increased. Consequently, uneven fixing of a toner image is also suppressed.

Third Exemplary Embodiment

A fixing unit 30 according to still another exemplary embodiment is described. Structural features and operations that are substantially the same as those according to the first exemplary embodiment are not described in detail.

Figure 6:
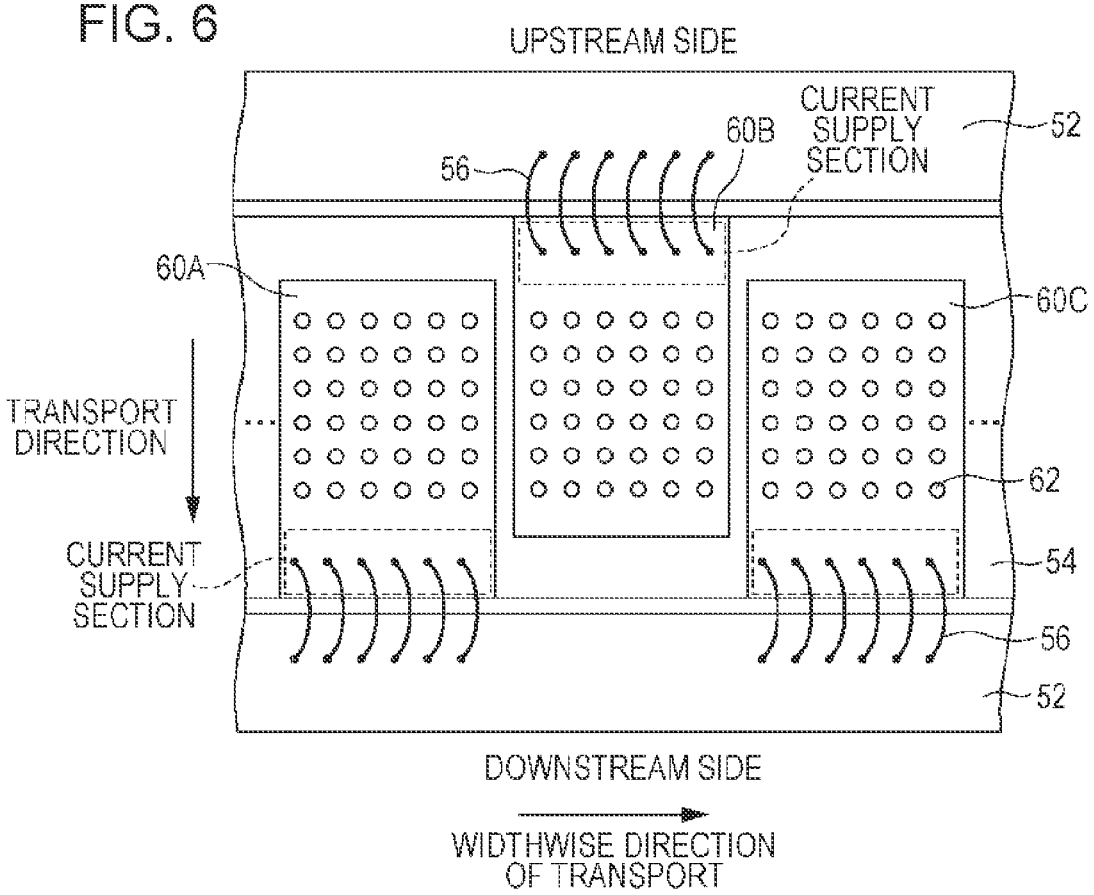
FIG. 6 is a plan view of a portion of a fixing unit according to a third exemplary embodiment when seen from the top thereof (that is, from a light illuminating side)

FIG. 6 is a plan view of a portion of the fixing unit 30 according to the third exemplary embodiment when seen from the top thereof (that is, from a light illuminating side). In the fixing unit 30 according to the first exemplary embodiment, the current supply sections of the light-emitting-element array chips 60 are disposed at both the upstream side and the downstream side in the transport direction. In contrast, in the third exemplary embodiment, as shown in FIG. 6, current supply sections are alternately disposed on either side of the respective light-emitting-element array chips 60. The other structural features of the third exemplary embodiment are substantially the same as those of the first exemplary embodiment.

Therefore, even in the third exemplary embodiment, as in the first exemplary embodiment, the light emitting elements 62 that are disposed side by side in the widthwise direction of transport are such that uneven light emission in the widthwise direction of transport is suppressed, so that uniformity in light amount distribution is increased.

Further, in the fixing unit 30 according to the third exemplary embodiment shown in FIG. 6, a light-emitting-element array chip 60A and a light-emitting-element array chip 60C are connected to a positive wire 52 that is disposed at a downstream side in the transport direction, and electric current is supplied to current supply sections that are disposed at the downstream side. A light-emitting-element array chip 60B is connected to a positive wire 52 that is disposed at the upstream side in the transport direction, and electric current is supplied to a current supply section that is disposed at the upstream side. Therefore, in the light-emitting-element array chip 60A and the light-emitting-element array chip 60C, electric current is supplied to the downstream current supply sections. Consequently, the light amounts of downstream light emitting elements 62 are large, whereas the light amounts of light emitting elements 62 that are disposed at the upstream side in the transport direction are small. In contrast, in the light-emitting-element array chip 60B, electric current is supplied to the upstream current supply section. Therefore, the light amounts of the upstream light emitting elements 62 are large, whereas the light amounts of light emitting elements 62 that are disposed at the downstream side in the transport direction are small. Therefore, when the fixing unit 30 is considered as a whole, uneven light emission in the widthwise direction of transport is suppressed, so that uniformity in light amount distribution is increased.

Even in the third exemplary embodiment, uneven fixing of a toner image is also suppressed.

FIG. 6 shows the case in which the light-emitting-element array chips 60 are alternately connected to a positive wire 52 at the upstream side in the transport direction and to a positive wire 52 at the downstream side in the transport direction. However, the light-emitting-element array chips 60 may be connected so that two light-emitting-element array chips 60 are connected to the positive wire 52 at the upstream side in the transport direction, the next two light-emitting-element array chips 60 are connected to the positive wire 52 at the downstream side in the transport direction, and so forth. From the viewpoint of suppressing uneven light emission in the transport direction, it is desirable that the difference between the number of light-emitting-element array chips 60 that are connected to the upstream positive wire 52 and the number of light-emitting-element array chips 60 that are connected to the downstream positive wire 52 be small. As shown in FIG. 6, it is desirable that the light-emitting-element array chips 60 be alternately connected to the upstream positive wire 52 and the downstream positive wire 52.

Fourth Exemplary Embodiment

A fixing unit 30 according to still another exemplary embodiment is described. Structural features and operations that are substantially the same as those according to the first exemplary embodiment are not described in detail.

Figure 7:
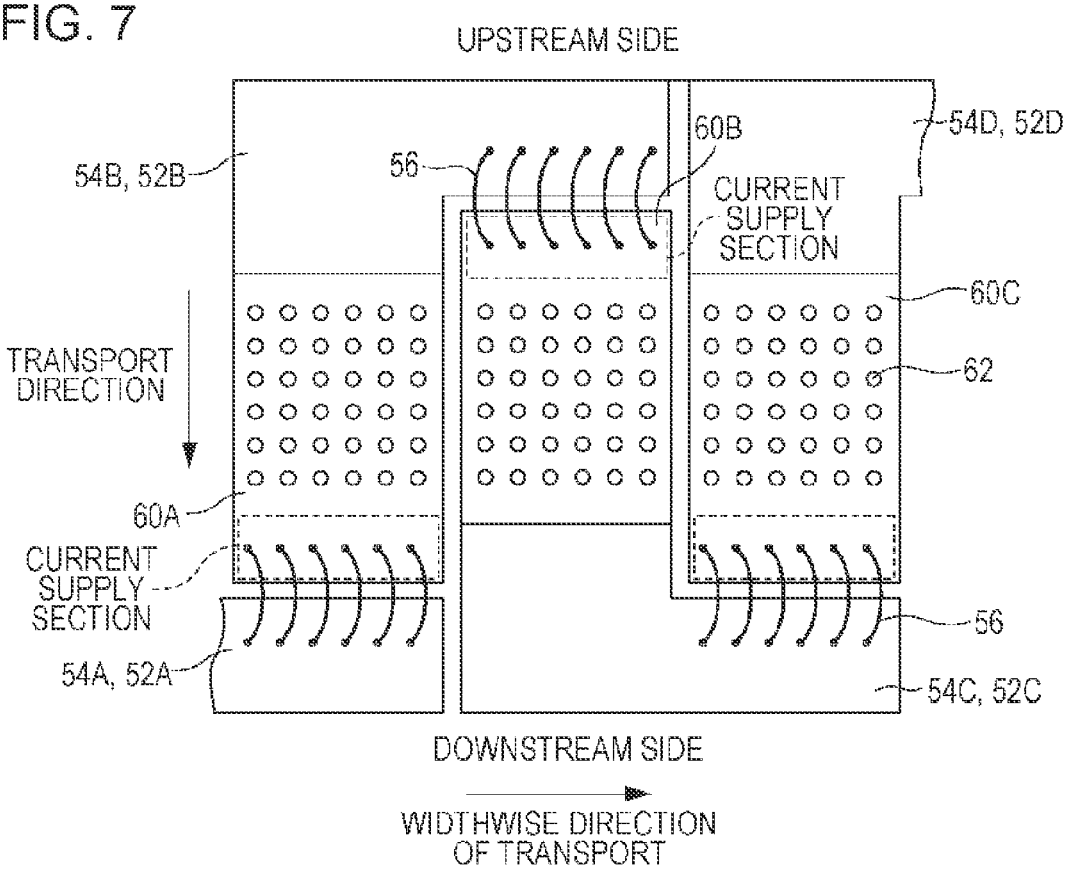
FIG. 7 is a plan view of a portion of a fixing unit according to a fourth exemplary embodiment when seen from the top thereof (that is, from a light illuminating side)

FIG. 7 is a plan view of a portion of the fixing unit 30 according to a fourth exemplary embodiment when seen from the top thereof (that is, from a light illuminating side). In the fixing unit 30 according to the first exemplary embodiment, the light-emitting-element array chips 60 are connected in parallel. In contrast, in the fourth exemplary embodiment, as shown in FIG. 7, the light-emitting-element array chips 60 are connected in series via positive wires 52 and negative wires 54. The other structural features of the fourth exemplary embodiment are substantially the same as those of the first exemplary embodiment.

In the fourth exemplary embodiment, since the positive wires 52, the negative wires 54, and the light-emitting-element array chips 60 are connected in series, one wire has the function of connecting the negative electrode 75 and the positive electrode 74 of the light-emitting-element array chip 60 that is adjacent thereto. In the fixing unit 30 shown in FIG. 7, electric current that has been supplied from the positive wire 52A to a current supply section of the light-emitting-element array chip 60 via bonding wires 56 flows to a negative wire 54B, and is supplied to a current supply section of the light-emitting-element array chip 60B via the bonding wires 56 with the negative wire 54B serving as a positive wire 52B. Further, electric current that has flowed from the light-emitting-element array chip 60B to a negative wire 54C is supplied to a current supply section of a light-emitting-element array chip 60C through the bonding wires 56 with the negative wire 54C serving as a positive wire 52C, and flows towards a negative wire 54D.

Accordingly, in the fourth exemplary embodiment, the positive wires 52, the negative wires 54, and the light-emitting-element array chips 60 are connected in series. Therefore, compared to the case in which the light-emitting-element array chips 60 are connected in parallel (for example, as in the above-described embodiments), the amount of electric current that flows through the entire fixing unit 30 is reduced.

Even in the fourth exemplary embodiment, as in the first exemplary embodiment, uneven light emission in the widthwise direction of transport is suppressed, so that uniformity in light amount distribution is increased. Therefore, uneven fixing of a toner image is also suppressed.

Therefore, as in the third exemplary embodiment, when the fixing unit 30 is considered as a whole, uneven light emission in the transport direction is suppressed, so that uniformity in light amount distribution is increased.

Fifth Exemplary Embodiment

A fixing unit 30 according to still another exemplary embodiment is described. Structural features and operations that are substantially the same as those according to the first exemplary embodiment are not described in detail.

Figure 8:
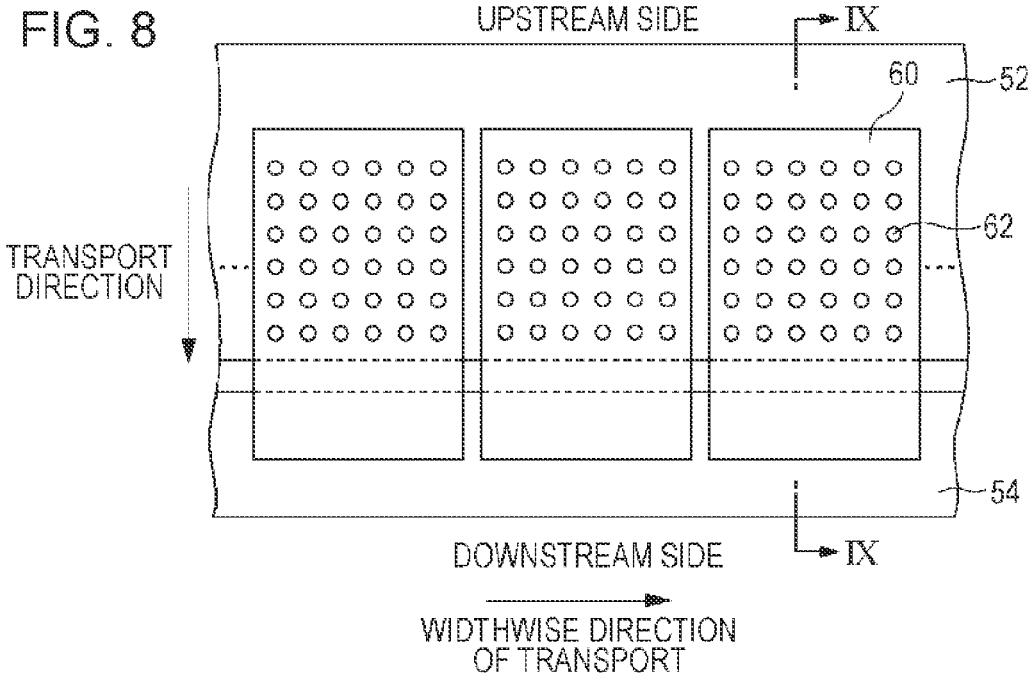
FIG. 8 is a plan view of a portion of a fixing unit according to a fifth exemplary embodiment when seen from the top thereof (that is, from a light illuminating side)
Figure 9:
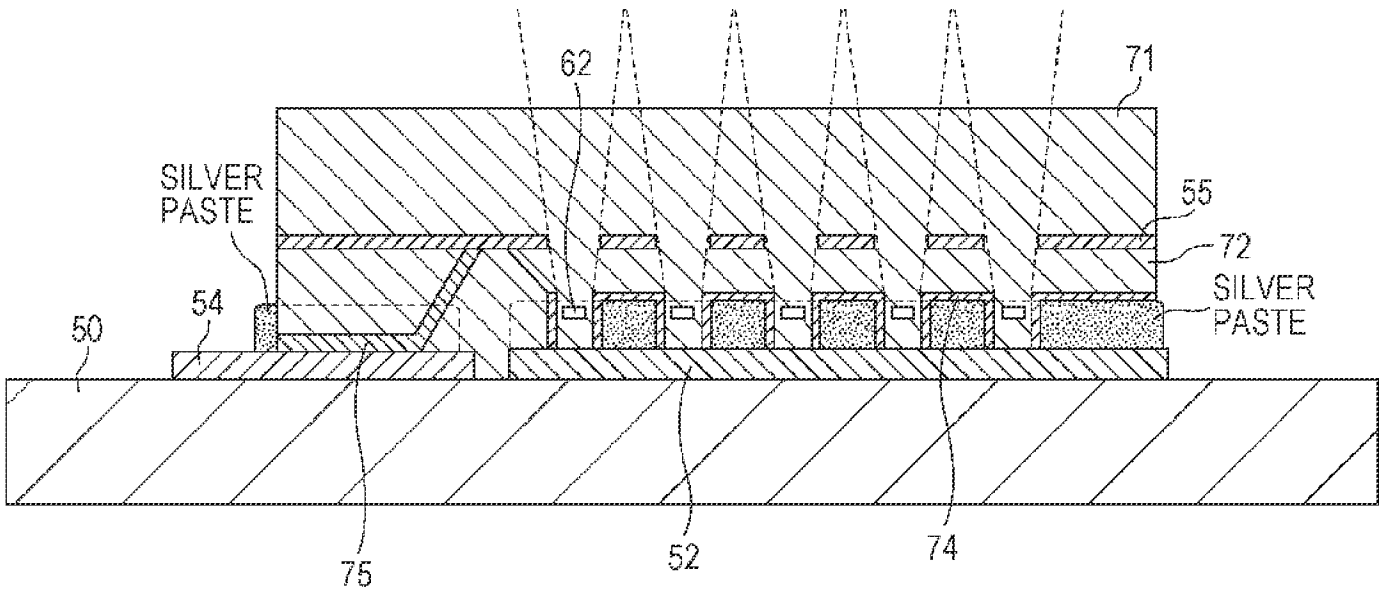
FIG. 9 is a sectional view taken along line IX-IX of the fixing unit shown in FIG. 8.

FIG. 8 is a plan view of a portion of the fixing unit 30 according to a fifth exemplary embodiment when seen from the top thereof (that is, from a light illuminating side). FIG. 9 is a sectional view taken along line IX-IX of the fixing unit 30 shown in FIG. 8. In the fixing unit 30 according to the first exemplary embodiment, surface-emitting-type light-emitting-element array chips 60 are used. In contrast, in the fifth exemplary embodiment, as shown in FIG. 9, backside-emitting-type light-emitting-element array chips 60 are used. In addition, in the fixing unit 30 according to the fifth exemplary embodiment, the light-emitting-element array chips 60, a positive wire 52, and a negative wire 54 are connected to positive electrodes 74 and negative electrodes 74 without using bonding wires 56, that is, by using, for example, a silver paste.

As shown in FIG. 9, in each light-emitting-element array chip 60, an internal electrode 55, a semiconductor layer 72, a positive electrode 74, and a negative electrode 75 are stacked upon each other on a semi-insulating (intrinsic), GaAs substrate 71. The internal electrode 55 includes an n-type GaAs layer. The semiconductor layer 72 is provided with a distribution bragg reflector (DBR) or an active layer including a p-type or an n-type semiconductor layer. Examples of p-type semiconductor layers are an AlGaAs semiconductor layer or an InGaAs semiconductor layer. The stacked structure is turned upside down, and mounted on a printed wiring board 50. The positive electrodes 74 according to the fifth exemplary embodiment each have a structure that is the same as that of each of the positive electrodes 74 according to the first exemplary embodiment except that current supply sections to which bonding wires 56 are connected are not provided.

Although, unlike each electrode formed of a metallic material according to the first exemplary embodiment, each internal electrode 55 has a semiconductor layer, the internal electrodes 55 are similar to the positive electrodes 74 according to the first exemplary embodiment in that they are formed continuously on both sides of the light emitting elements 62. In the interiors of the light-emitting-element array chips 60, the internal electrodes 55 are connected to the negative electrodes 75 that extend from the back sides to the inner portions of the light-emitting-element array chips 60, and cause electric current that has passed through the light emitting elements 62 to flow to the negative electrodes 75.

Like the positive electrodes 74, the negative electrodes 75 are formed of metallic materials, such as Au. However, unlike the negative electrodes 75 in the first exemplary embodiment, the negative electrodes 75 are provided on the same side of the printed wiring substrate 50 as the positive electrodes 74 are. Each negative electrode 75 has a continuous surface having a width that substantially corresponds to the width of the corresponding light-emitting-element array chip 60 in the widthwise direction of transport.

Each positive electrode 74 is connected to the positive wire 52 using, for example, a silver paste at an upstream side of the corresponding light-emitting-element array chip 60 in the transport direction. Each negative electrode 75 is connected to the negative wire 54 using, for example, a silver paste at a downstream side of the corresponding light-emitting-element array chip 60 in the transport direction. That is, in the fifth exemplary embodiment, each positive electrode 74, which is connected to the positive wire 52 using a silver paste, constitutes a current supply section as a whole. Electric current that has been supplied from the positive wire 52 to the positive electrode 74 of each light-emitting-element array chip 60 flows to the internal electrode 55 via the light emitting elements 62, flows through the internal electrode 55 along the transport direction, and flows to the negative wire 54 via the negative electrode 75. The other structural features of the fifth exemplary embodiment are substantially the same as those of the first exemplary embodiment.

As shown in FIG. 9, the backside-emitting-type light-emitting-element array chips 60 differ from the surface-emitting-type light-emitting-element array chips 60 according to the first exemplary embodiment in that semiconductor layers are used as internal electrodes. Therefore, the resistance values of the electric current paths in the backside-emitting-type light-emitting-element array chips 60 tend to be larger than the resistance values of the electric current paths in the surface-emitting-type light-emitting-element array chips 60. Consequently, light amount variations that are in correspondence with the electric current paths tend to occur. However, in the fifth exemplary embodiment, as in the first exemplary embodiment, electric current flows in the transport direction at the light emitting elements 62 that are disposed side by side in the widthwise direction of transport. Therefore, uneven light emission in the widthwise direction of transport is suppressed, as a result of which uniformity in light amount distribution is increased. Consequently, uneven fixing of a toner image is also suppressed.

Accordingly, when application is made to the backside-emitting-type light-emitting-element array chips 60, uneven light emission in the widthwise direction of transport is more effectively suppressed.

As shown in FIG. 9, in each backside-emitting-type light-emitting-element array chip 60, light that is emitted from the light emitting elements 62 is transmitted through the substrate 70, and illuminates the sheet 28. In each backside-emitting-type light-emitting-element array chip 60, compared to each surface-emitting-type light-emitting-element array chip 60, the light emitting elements 62 are provided closer to the printed wiring board 50. Therefore, when a cooling section is provided at the printed wiring board 50, heat of the light emitting elements 62 is more efficiently absorbed in the backside-emitting type than in the surface-emitting-type type. Therefore, stability is increased.

Sixth Exemplary Embodiment

A fixing unit 30 according to still another exemplary embodiment is described. Structural features and operations that are substantially the same as those according to the first exemplary embodiment are not described in detail.

Figure 10:
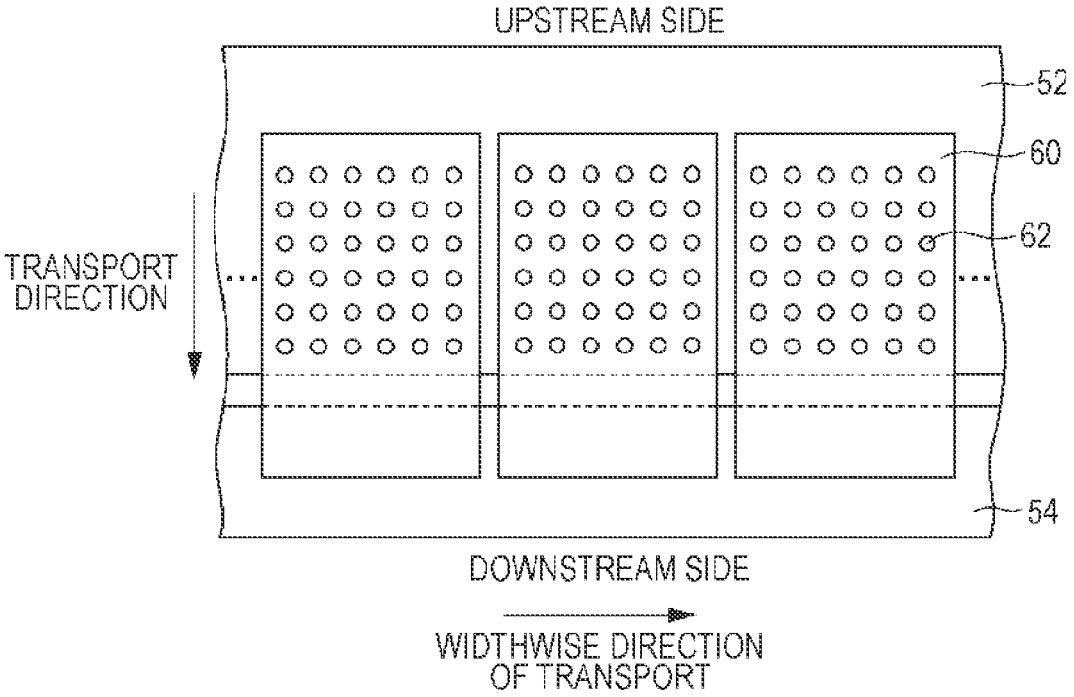
FIG. 10 is a plan view of a portion of a fixing unit according to a sixth exemplary embodiment when seen from the top thereof (that is, from a light illuminating side)

FIG. 10 is a plan view of a portion of the fixing unit 30 according to a sixth exemplary embodiment when seen from the top thereof (that is, from a light illuminating side). In the sixth exemplary embodiment, a positive wire 52 is provided at an upstream side of light-emitting-element array chips 60 in the transport direction, and a negative wire 54 and negative electrodes 75 are provided at a downstream side of the light-emitting-element array chips 60 in the transport direction. In addition, in the sixth exemplary embodiment, electric current that has been supplied to positive electrodes 74 flows from the upstream side to the downstream side of the light-emitting-element array chips 60. In FIG. 10, similarly to the fifth exemplary embodiment, for example, the light-emitting-element array chips 60, the positive wire 52, and the negative wire 54 are connected to each other without using bonding wires 56, that is, they are connected to each other using, for example, a silver paste. The other structural features of the sixth exemplary embodiment are substantially the same as those of the first exemplary embodiment and the fifth exemplary embodiment.

In the sixth exemplary embodiment, in each backside-emitting-type light-emitting-element array chip 60 including an internal electrode 55 formed of a semiconductor layer, a larger amount of electric current flows at the light emitting elements 62 that are at the side that is close to the negative wire 54 (that is, the downstream side) than the light emitting elements 62 that are at the side that is far away from the negative wire 54 (that is, the upstream side) because a path extending through the internal electrode 55 having a high resistance becomes short. Therefore, the light emission amount becomes large. Since the peak of the light emission amount exists towards the downstream side in the transport direction, the amount of light that illuminates a predetermined region of the sheet 28 is at first small, and, then, gradually increases.

When a toner image is fixed in the image forming apparatus 10, it is desirable that toner of the toner image be preliminarily heated, and heating required for fixing be performed after the preliminary heating. In the sixth exemplary embodiment, since the peak of the light emission amount exists at the downstream side in the transport direction, after performing the preliminary heating as a result of illuminating the toner with a small amount of light, the toner is illuminated with a large amount of light to perform the heating of the toner required for fixing the toner image.

Accordingly, when the fixing unit 30 that fixes a toner image is used, a larger effect is obtained by disposing the negative electrode 75, the light emitting section, and the current supply section of each light-emitting-element array chip 60 so that the amount of light that illuminates a predetermined region of the sheet 28 is at first small and then gradually increases. The exemplary embodiment is not limited to a backside-emitting light source. A surface-emitting light source may also be used. For example, in a surface-emitting light source in the second exemplary embodiment, the distance that electric current flows through the positive electrode 74 is short at the light emitting elements 62 that are far away from the negative electrode 75 (that is, the light emitting elements 62 that are close to the current supply section). Since the light emission amounts are large at these light emitting elements 62, the negative electrode 75 is disposed at the upstream side in the transport direction, and the positive electrode 74 is disposed at the downstream side in the transport direction.

Seventh Exemplary Embodiment

A fixing unit 30 according to still another exemplary embodiment is described. Structural features and operations that are substantially the same as those according to the first exemplary embodiment are not described in detail.

Figure 11:
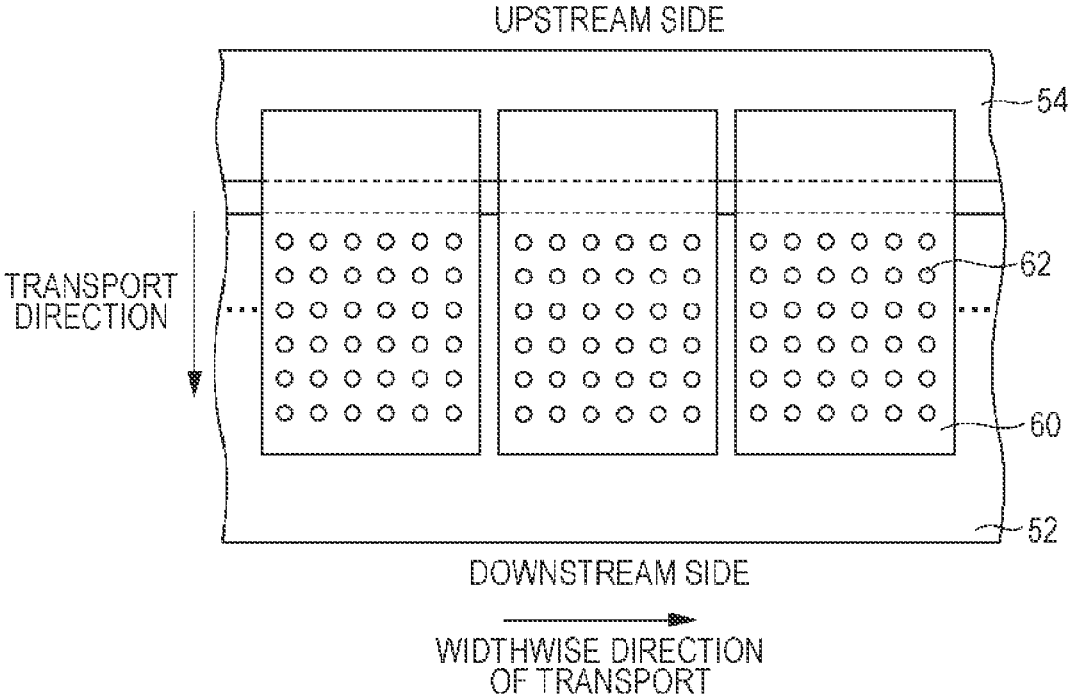
FIG. 11 is a plan view of a portion of a fixing unit according to a seventh exemplary embodiment when seen from the top thereof (that is, from a light illuminating side)

FIG. 11 is a plan view of a portion of the fixing unit 30 according to a seventh exemplary embodiment when seen from the top thereof (that is, from a light illuminating side). In the seventh exemplary embodiment, a positive wire 52 is provided at a downstream side of light-emitting-element array chips 60 in the transport direction, and electric current that has been supplied to positive electrodes 74 flow from the downstream side to an upstream side of the light-emitting-element array chips 60. In FIG. 11, similarly to the fifth exemplary embodiment, for example, the light-emitting-element array chips 60, the positive wire 52, and the negative wire 54 are connected to each other without using bonding wires 56, that is, they are connected to each other using, for example, a silver paste. The other structural features of the seventh exemplary embodiment are substantially the same as those of the first exemplary embodiment and the fifth exemplary embodiment.

In the seventh exemplary embodiment, contrary to the sixth exemplary embodiment, the peak of light emission amount exists at the upstream side in the transport direction. Therefore, the amount of light that illuminates a predetermined region of a sheet 28 is at first small, and, then, gradually increases.

Therefore, when it is desirable that the amount of light that illuminates the sheet 28 be gradually reduced, it is desirable to use the structure according to the seventh exemplary embodiment. As described in the sixth exemplary embodiment, the exemplary embodiment is not limited to a backside-emitting light source. A surface-emitting light source may also be used.

Although, in each of the exemplary embodiments, the image forming apparatus 10 (fixing unit 30) that forms an image using toner, it is particularly desirable that, in each of the exemplary embodiments, an image forming apparatus 10 (drying device) that forms an image using ink be used (described in detail below).

As described above, in each of the above-described exemplary embodiments, the negative electrodes 75, the light emitting elements 62, and the current supply sections that supply electric current to the light-emitting-element array chips 60 are provided side by side in the transport direction of a sheet 28. Electric current that flows to the negative electrodes 75 from the current supply sections through the light emitting elements 62 flows in the transport direction in a range substantially corresponding to the width of a recording medium. Therefore, uneven light emission in the widthwise direction of transport is suppressed, as a result of which uniformity in light amount distribution is increased. Consequently, uneven fixing of a toner image is also suppressed.

The current supply sections, the light emitting elements 62, and the negative electrodes 75 need not be provided completely along the transport direction. Any structure may be used as along as the electric current that flows in the light-emitting-element array chips 60 as a whole flows in the transport direction rather than in the widthwise direction of transport. It is desirable that the largest amount of electric current flow in a direction that substantially corresponds to the transport direction. For example, it is desirable that the current supply sections, the light emitting elements 62, and the negative electrodes 75 be disposed linearly side by side in a direction that substantially corresponds to the transport direction.

In each of the exemplary embodiments, the positive wire 52 and the negative wire 54 may be interchanged. In addition, the polarities of the light-emitting-element array chips 60 may be interchanged. For example, in each of the exemplary embodiments, the positive wire 52 may be a negative wire, and the negative wire 54 may be a positive wire. Further, the polarity of the p-type semiconductor and the polarity of the n-type semiconductor of each light-emitting-element array chip 60 may be interchanged. By the interchanging, the positions of the current supply sections and the positions of the current output sections are also interchanged.

Although, in each of the above-described exemplary embodiments, the case in which a sheet 28 is moved is described, the fixing unit 30 may be moved, or both the sheet 28 and the fixing unit 30 may be moved. Any structure may be used as long as the fixing unit 30 and the sheet 28 move relative to each other.

Although, in each of the above-described exemplary embodiments, VCSELs are used as light-emitting-element array chips 60, other types of surface-emitting lasers or light-emitting elements may be used. From the viewpoint of reducing costs and increasing reliability and high-temperature stability due to increasing output of a light source, it is desirable to use surface-emitting lasers (VCSELs) as in the exemplary embodiments.

The image forming apparatus 10 is not limited to the above-described exemplary embodiments. For example, although each of the above-described exemplary embodiments is applied to the self-scanning electrophotographic image forming apparatus 10, the image forming apparatus is not limited thereto. For example, the image forming apparatus 10 may be one that forms a monochromatic image, or one that forms an image of a plural number of colors.

In addition, for example, although, in each of the above-described exemplary embodiments, the image forming apparatus 10 (fixing unit 30) that forms an image using toner is described, the image forming apparatus 10 may be one that forms an image using ink. An exemplary image forming apparatus 10 that forms an image using ink is described.

Figure 12:
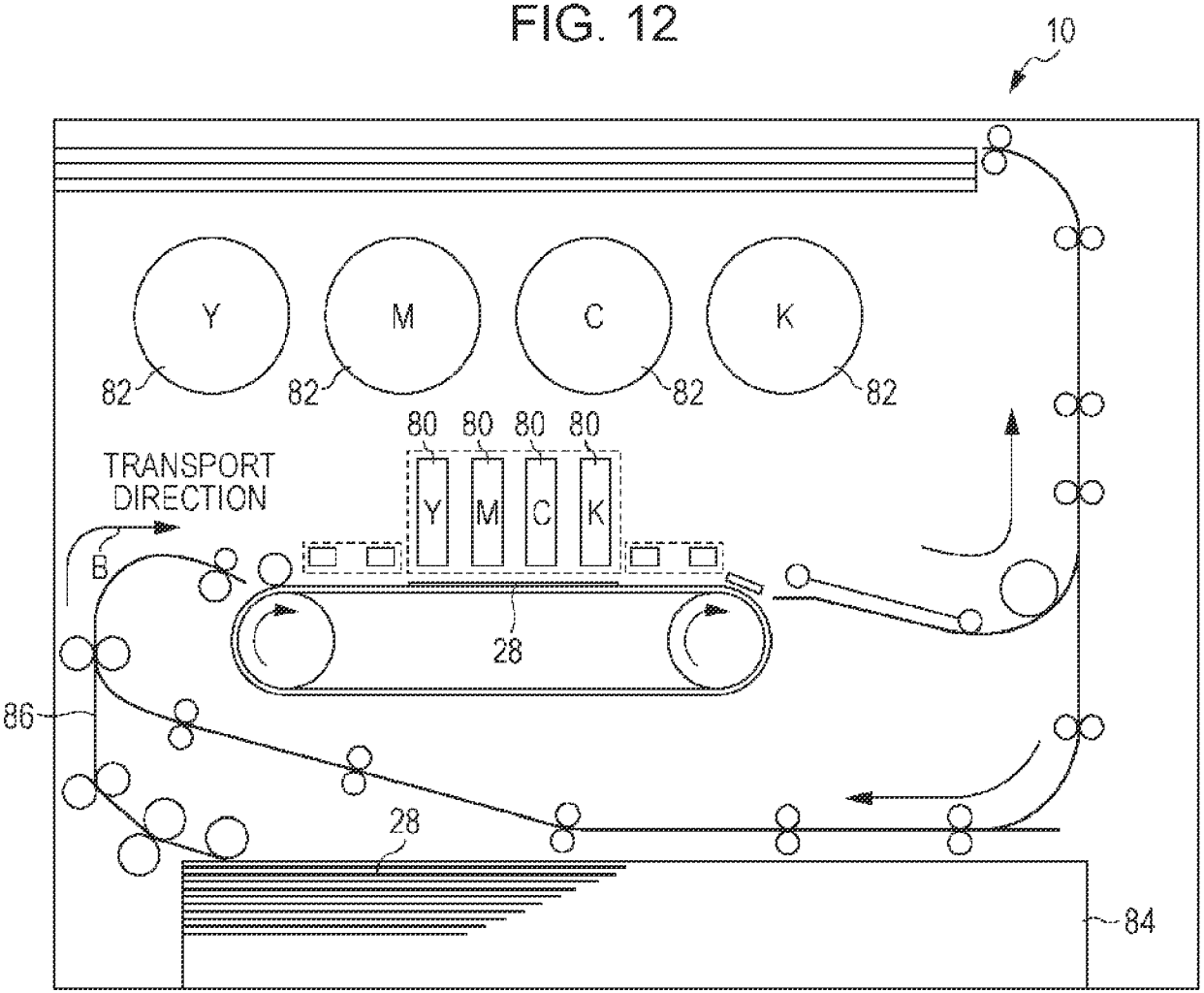
FIG. 12 is a schematic view of the structure of an image forming apparatus (inkjet recording apparatus) that forms an image using ink.

FIG. 12 is a schematic view of the structure of an image forming apparatus (inkjet recording apparatus) 10 that forms an image using ink. The image forming apparatus 10 shown in FIG. 12 includes four recording/drying combined heads 80 (discharging device/drying device) which are provided in correspondence with four colors, that is, yellow (Y), magenta (M), cyan (C), and black (K), and which are disposed in the transport direction. The image forming apparatus 10 shown in FIG. 12 records a full-color image. The image forming apparatus 10 is also provided with ink tanks 82 that store inks of four colors, respectively. Ink drops are discharged from the recording/driving combined heads 80 of the corresponding colors. The method of discharging ink drops is not particularly limited. Publicly known systems, such as a thermal system or a piezoelectric system, are used. Various types of publicly known inks, such as aqueous ink, oil-based ink, and solvent ink, are used as the ink.

Sheets 28 that are stacked in a sheet-feed tray 84 are taken out, and are transported to the recording/drying combined heads 80 of the corresponding colors via a transport path 86 while being held by a transport belt. The recording/drying combined heads 80 discharge ink drops corresponding to pieces of image data onto a sheet 28. The sheet 28 is irradiated with light to dry the ink drops on the sheet 28. Similarly to the fixing unit 30 according to each of the exemplary embodiments, the structure that dries ink drops in a driving system of each of the recording/driving combined heads 80 of the corresponding color is one in which the sheet 28 is irradiated with light emitted from the light emitting elements 62 of the light-emitting-element array chips 60 that are disposed on the printed wiring substrate 50 in the widthwise direction of transport. In the order corresponding to the transport of the sheet 28, images of the corresponding colors are successively formed using the recording/drying combined heads 80 of the corresponding colors. The sheet 28 to which a desired image has been formed is discharged to the outside of the image forming apparatus 10.

Accordingly, in the image forming apparatus 10 that forms an image using ink, the sheet 28 is irradiated with light to dry the ink drops on the sheet 28. Therefore, similarly to the fixing unit 30 that has been described in each of the exemplary embodiments, light amount variation in the widthwise direction of transport causes uneven drying of the ink drops. Consequently, when the structure for drying ink drops is made similar to that of the fixing unit 30 that has been described in each of the exemplary embodiments, uneven light emission in the widthwise direction of transport is suppressed, as a result of which uniformity in light amount distribution is increased. Consequently, uneven drying of ink drops is also suppressed.

If, after drying the ink drops by heating the ink drops as a result of irradiating the ink drops with light, the heating of the ink drops is continued, the sheet 28 may be excessively heated. Therefore, it is desirable to reduce the amount of light, used for illuminating the sheet 28 so as to suppress heating as the drying of the ink drops is continued, in accordance with the drying of the ink drops.

When a drying device that dries ink drops is used, it is desirable that the structure that has been described in the seventh exemplary embodiment be used.

The foregoing description of the exemplary embodiments of the present invention has been provided for the purposes of illustration and description. Obviously, various modifications may be made in accordance with the circumstances within a scope that does not depart from the gist of the present invention.

What is claimed is:

1. An image forming apparatus comprising:

an image forming device that forms an image on a recording medium, a light source that, after the image has been formed by the image forming device, irradiates the recording medium with light to fix the image on the recording medium, while the recording medium moves relatively in a predetermined movement direction, and a substrate that comprises the light source;

wherein the light source includes a current supply section, a light emitting section, and a current output section, electric current for light emission being supplied to the current supply section, the light emitting section including a plurality of light emitting elements that are disposed two-dimensionally, at least the light emitting elements that are provided side by side in the movement direction among the plurality of light emitting elements being electrically connected in parallel, the current output section outputting the electric current that has passed through the light emitting section, and wherein the current supply section, the light emitting section and the current output section are provided on the substrate such that the electric current flows substantially parallel to a transport direction in the light emitting section.

2. The image forming apparatus according to claim 1, wherein the current supply section, the light emitting section, and the current output section are provided in a range that substantially corresponds to a width of the recording medium in a direction that crosses the movement direction.

3. The image forming apparatus according to claim 2, wherein the light source includes a plurality of light-emitting-element array chips, each light-emitting-element array chip including the current supply section, the light emitting section, and the current output section, and wherein the current supply section and the current output section of each light-emitting-element array chip are provided substantially in accordance with a width of the corresponding light emitting section in the direction crossing the movement direction.

4. The image forming apparatus according to claim 3, wherein the electric current is supplied to each light-emitting-element array chip so as to be alternately supplied from the current supply sections at an upstream side and a downstream side in the movement direction.

5. The image forming apparatus according to claim 3, wherein each light-emitting-element array chip includes a plurality of the current supply sections and a plurality of the current output sections, and wherein each light-emitting-element array chip is connected so that the plurality of the current supply sections and the plurality of the current output sections are connected in series.

6. The image forming apparatus according to claim 1, wherein the current supply section and the current output section of the light source are disposed at a surface that is opposite to a light exiting surface, and wherein the light source further includes an internal electrode in a path through which the electric current flows from the current supply section to the current output section, the internal electrode being formed of a semiconductor.

7. The image forming apparatus according to claim 1, wherein one of the current supply section and the current output section is disposed upstream or downstream from the other of the current supply section and the current output section in the movement direction.

8. The image forming apparatus according to claim 1, wherein the light source is a surface-emitting laser.

9. The image forming apparatus according to claim 1, wherein the image forming device includes a photoconductor member, a charging device that charges a surface of the photoconductor member, an exposing device that forms an electrostatic latent image by, on the basis of image data, exposing the surface of the photoconductor member that has been charged by the charging device, a developing device that develops the electrostatic latent image that has been formed by the exposing device, a transfer device that transfers the electrostatic latent image developed by the developing device to the recording medium, and a fixing device that includes the light source, the fixing device fixing the electrostatic latent image that has been transferred onto the recording medium by the transfer device to the recording medium by irradiating the electrostatic latent image with the light from the light source.

10. A fixing device comprising:

the light source used in the image forming apparatus according to claim 9.

11. The image forming apparatus according to claim 1, wherein the image forming device includes a discharging device that, on the basis of image data, discharges ink onto recording medium to form the image on the recording medium, and a drying device that includes the light source and that dries the ink that has been discharged onto the recording medium by irradiating the ink with the light from the light source.

12. A drying device comprising:

the light source used in the image forming apparatus according to claim 11.

13. The image forming apparatus according to claim 1, wherein the light source includes a plurality of the light-emitting-element array chips, each light-emitting-element array chip including the current supply section, the light emitting section, and the current output section, and each light-emitting-element array chip has a square shape and is provided on the substrate such that a side of the light-emitting-element array chip is perpendicular to or parallel to the transport direction.

14. An image forming apparatus comprising:

an image forming device that forms an image on a recording medium; and a light source that, after the image has been formed by the image forming device, irradiates the recording medium with light to fix the image on the recording medium, while the recording medium moves relatively in a predetermined movement direction; and a substrate that comprises the light source, wherein the light source includes a current supply section, a light emitting section, and a current output section, electric current for light emission being supplied to the current supply section, the light emitting section including a plurality of light emitting elements that are disposed two-dimensionally, at least the light emitting elements that are provided side by side in the movement direction among the plurality of light emitting elements being electrically connected in parallel, the current output section outputting the electric current that has passed through the light emitting section, and wherein the current output section, the light emitting section and the current output section are provided on the substrate such that the electric current flows substantially parallel to a transport direction in the light emitting section.

* * * * *